United States Patent [19]

Masuda

[11] Patent Number: 4,493,526

[45] Date of Patent: Jan. 15, 1985

[54] JACK

[75] Inventor: Toru Masuda, Higashiosaka, Japan

[73] Assignee: Hosiden Electronics Co., Ltd., Osaka, Japan

[21] Appl. No.: 458,518

[22] Filed: Jan. 17, 1983

[30] Foreign Application Priority Data

Feb. 27, 1982 [JP] Japan ..... 57/10728[U]

[51] Int. Cl.[3] ..... H01R 17/18

[52] U.S. Cl. ..... 339/183; 339/259 R; 339/255 R

[58] Field of Search ..... 339/255, 259, 176 MF, 339/183

[56] References Cited

U.S. PATENT DOCUMENTS

| | | | |
|---|---|---|---|
| 2,235,545 | 3/1941 | Young | 339/255 R |
| 3,002,172 | 9/1961 | Lennox | 339/255 R |
| 3,126,241 | 3/1964 | Papalas | 339/255 R |
| 3,180,924 | 4/1965 | Rowe | 339/255 R |
| 3,277,427 | 10/1966 | Jurca | 339/259 R |
| 3,286,326 | 11/1966 | Klotz | 339/259 R |
| 4,040,712 | 8/1977 | Dahlstrom | 339/255 R |

*Primary Examiner*—Joseph H. McGlynn
*Assistant Examiner*—David L. Pirlot
*Attorney, Agent, or Firm*—Pollock, VandeSande and Priddy

[57] ABSTRACT

In a jack in which a movable contact piece mounted therein is displaced by a plug inserted thereinto and a coiled spring for supplementing the resiliency of the movable contact piece is interposed between a movable part of the movable contact piece and the body of the jack, there is disposed a spring holder between the movable part and the body, whereby the coiled spring is held and excessive displacement of the movable part is prevented.

8 Claims, 12 Drawing Figures

JACK

BACKGROUND OF THE INVENTION

The present invention relates to an electrical connector comprising a jack which has incorporated therein a movable contact piece so arranged that when a plug is inserted into the jack, the movable contact piece is connected with the plug and, at the same time, is disconnected from another contact piece in the jack, and when the plug is pulled out of the jack the movable contact piece in the jack recovers its original state.

Conventional jacks of this kind often become defective owing to deteriorated resiliency of the movable contact piece caused by repeated insertion and pulling out of the plug. In view of this, it has been proposed to interpose a coiled spring between the movable contact piece and a stationary part of the jack to supplement the resiliency of the movable contact piece, thereby to lengthen the lifetime of the jack. In this prior art jack, the coiled spring is not held firmly in place, and hence is likely to get out of position while in use. Furthermore, conventional jacks, in particular small ones, have the defect that, when assembling them, it is difficult to hold the coiled spring in position.

Moreover, there is the possibility in the prior art arrangement that when the plug inserted into the jack receives an external force across the axis of a plug insertion hole of the jack, the movable contact piece can be excessively displaced by the inserted end portion of the plug, and permanently deformed. To avoid this, there has been proposed a jack designed so that, when the movable contact piece is displaced to a predetermined extent, it is received by a protective member to prevent further displacement.

SUMMARY OF THE INVENTION

It is therefore an object of the present invention to provide a jack which is long-lived and free from the fear of the movable contact piece being permanently deformed by the plug.

Another object of the present invention is to provide a jack which has a long life, prevents excessive displacement of the movable contact piece and is easy to assemble but firmly holds the coiled spring in position.

Yet another object of the present invention is to provide a jack which is small in size, requires a relatively large force for pulling out therefrom the plug, provides a relatively high contact pressure between the movable contact piece and the plug or some other contact piece, has a long life, and is highly reliable.

According to the present invention, in a jack of the type having a movable contact piece in a body of insulating material and a coiled spring interposed between a movable part of the movable contact piece and the body, the jack being so arranged that the movable contact piece is displaced by a plug when the latter is inserted into the body, there is disposed a spring holder between the movable part of the movable contact piece and the body for holding the coiled spring in place in the body. When the movable part of the movable contact piece is displaced by the plug in excess of a predetermined value, the spring holder interposed between a plug contact portion of the movable part of the movable contact piece and the body prevents further excessive displacement of the movable contact piece.

Furthermore, the movable contact piece is fixed by the spring holder to the body as required.

DESCRIPTION OF THE PREFERRED EMBODIMENTS

Figure 2:
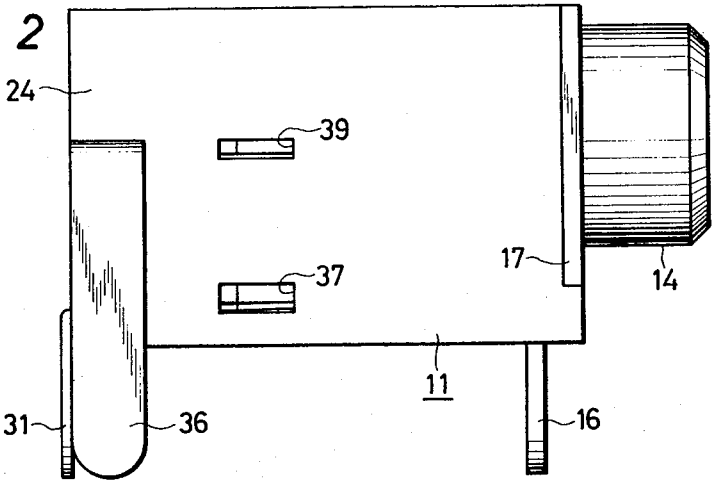
FIG. 2 is a left side view of the jack.
Figure 4:
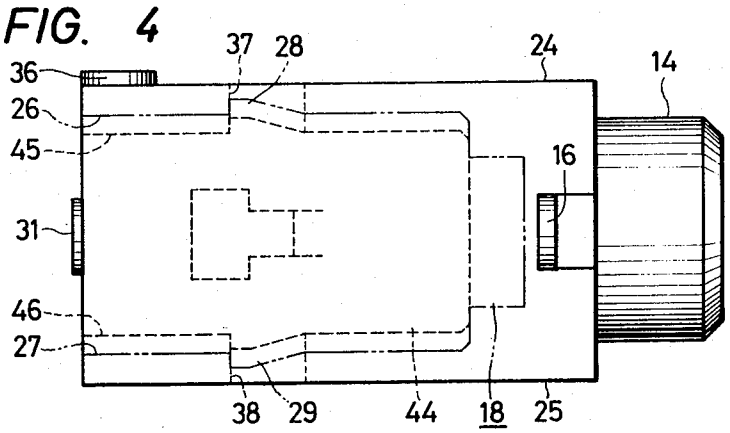
FIG. 4 is a bottom view of the jack.
Figure 1:
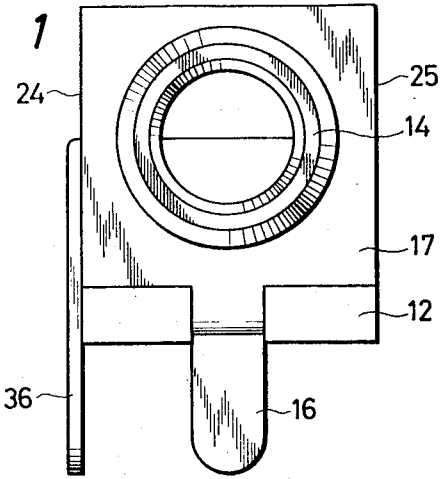
FIG. 1 is a front view showing an embodiment of the jack of the present invention.
Figure 5:
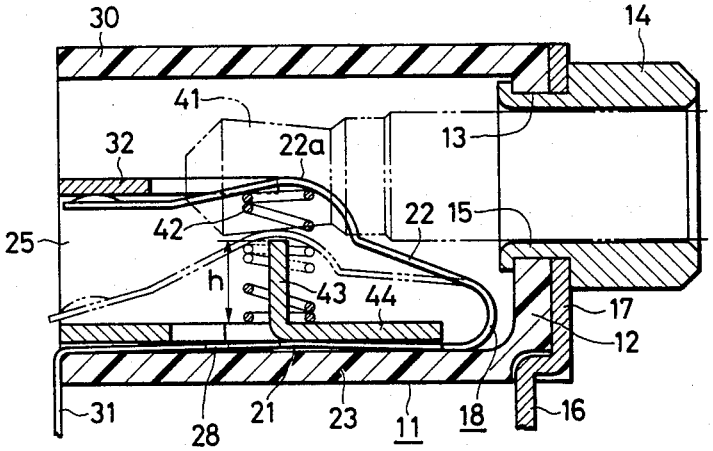
FIG. 5 is a longitudinal sectional view of the jack.

FIGS. 1 to 5 illustrate an embodiment of the jack of the present invention. A body 11 is a four-sided right prismatic member, which is produced, for example, by molding of a synthetic resinous material. One end of the body 11 is closed by a front panel 12 formed integrally therewith as shown in FIG. 5 and a plug insertion hole 13 is made in the front panel 12. A sleeve 14, which is coaxial with the plug insertion hole 13, is formed to extend forwardly of the front panel 12. In this embodiment, the sleeve 14 is formed by a metal tube, the rear end portion of which is reduced in its outer diameter to be small in thickness. The reduced thickness portion 15 of the sleeve 14 is fitted into the plug insertion hole 13 from the front thereof and its inner end is bent outwardly along the interior surface of the front panel 12, by which the sleeve 14 is staked to the front panel 12.

In FIGS. 1 to 5, a grounding terminal 16 is also fixed to the body 11, together with the sleeve 14. A plate member 17 is formed integrally with the plate-shaped grounding terminal 16 at one end thereof; the reduced thickness portion 15 of the sleeve 14 is inserted into a center hole made in the plate member 17; and the plate member 17 is pressed against the front of the front panel 12. Thus the plate member 17 is fixed to the front panel 12, together with the sleeve 14.

Figure 3:
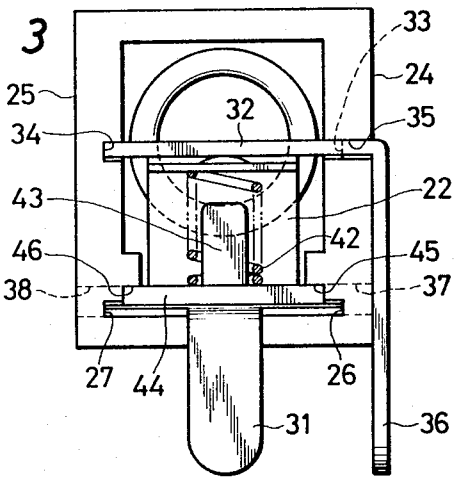
FIG. 3 is a rear view of the jack.
Figure 6:
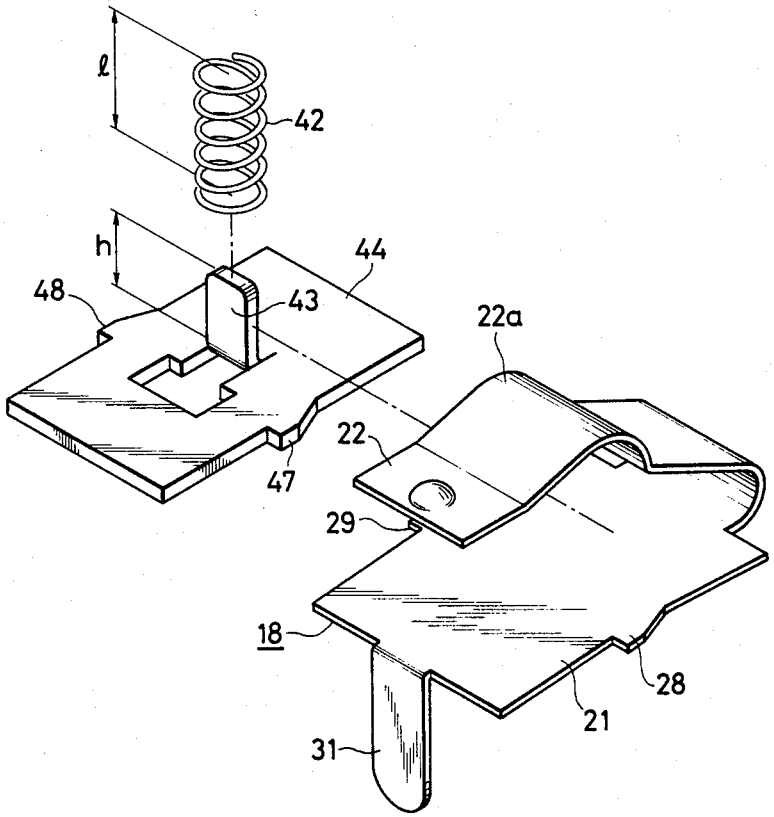
FIG. 6 is an exploded perspective view showing a movable contact piece 18, a coiled spring 42 and a spring holder 43 used in FIG. 5.

In the body 11 is disposed a movable contact piece 18. In this embodiment, the movable contact piece 18 is formed by bending a piece of resilient sheet metal into a U-shape in cross-section, one leg portion of which is used as a stationary part 21 and the other leg portion of which is used as a movable part 22, as shown in FIGS. 5 and 6. The stationary part 21 is pressed against the interior surface of a bottom panel 23 of the body 11, and a bent portion interconnecting the stationary part 21 and the movable part 22 is disposed near the front panel 12. As illustrated in FIGS. 3 and 4, guide grooves 26 and 27 are cut in the body 11 to extend along the boundaries between left and right side panels 24 and 25 and the bottom panel 23 of the body 11 from its rear open end. The movable contact piece 18 is inserted into the body 11 from its rear opening, with both marginal side edges of the stationary part 21 received and guided by the guide grooves 26 and 27. The stationary part 21 has lugs 28 and 29 formed integrally therewith centrally of its said marginal side edge portions, and when the stationary part 21 is inserted by force into the body 11 along the guide grooves 26, 27, the lugs 28 and 29 are engaged with holes 37 and 38 made in the left and right side panels 24 and 25 of the body 11 halfway along the guide grooves 26 and 27 to lock the movable contact piece 18 in position. A terminal 31 is bent at right agles to extend from the center of the rear marginal edge of the stationary part 21, projecting out of the body 11.

A stationary contact piece 32 is fixedly mounted in the body 11 for resiliently engaging the free end portion of the movable contact piece 18. That is to say, the free end portion of the movable part 22 of the movable contact piece 18 is urged against the stationary contact piece 32 from the side of the bottom panel 23 of the body 11 as shown in FIGS. 3 and 5. Although not shown in the drawings, the stationary contact piece 32 is formed by a metal plate in a U-shape. The two arm portions of the U-shaped piece 32 are inserted into grooves 33, 34 which are cut in the interior surfaces of the side panels 24, 25 to extend from the rear open end of the body 11 towards the front panel 12. The groove 33 is also extended, at the rear end side of the side panel 24, to reach the outer surface thereof to form a groove 35, through which a part of the base portion of the U-shaped stationary contact piece 32 projects out. The projecting portion is bent at right angles to extend down along the outside surface of the side panel 24 towards the bottom panel 23, thus forming a terminal 36. The arm portions of the U-shaped stationary contact piece 32 extending forwardly have, on the outside of its two arm portions, lugs similar to those of the movable contact piece 18 though not shown in the drawings, and these lugs are engaged with holes made in the body 11 to lock the stationary contact piece 32 in position. One of the engaging holes is indicated by reference numeral 39 in FIG. 2.

When a plug 41 is inserted into the body 11 through the sleeve 14 from its front as shown in FIG. 5, the tip of the plug 41 is situated between the two arm portions of the stationary contact piece 32 without having in contact therewith and the movable part 22 of the movable contact piece 18 is elastically deformed by the plug 41 to approach the stationary part 21; namely, the movable contact piece 18 is pressed out of contact with the base portion of the stationary contact piece 32 as indicated by the two-dotted chain line, disconnecting the terminals 31 and 36 from each other. In order to ensure that the movable contact piece 22 makes good contact with the peripheral surface of the plug 41, the intermediate portion of the movable part 22 of the movable contact piece 18 is bent to form a plug contact portion **22*a* projecting towards an upper panel 30. When pulling out the plug 41 from the body 11, the movable contact piece 18 is restored to its initial state to make elastic contact with the stationary contact piece 32, interconnecting the terminals 31 and 36**.

In order to supplement the resilient force of the movable contact piece 18 against the stationary contact piece 32, a coiled spring 42 is interposed between the movable part 22 of the movable contact piece 18 and the body 11. The coiled spring 42 is held by a spring holder 43 disposed between the movable part 22 and the body 11. In this embodiment, a metal keep plate 44 is provided to abut against the bottom panel 23 through the stationary part 21 of the movable contact piece 18. As depicted in FIGS. 5 and 6, the spring holder 43 is formed by cutting and turning up the central portion of the keep plate 44. The spring holder 43 is formed to stand substantially parallel to the front panel 12 and extends towards substantially the central portion of the plug contact portion **22*a* of the movable contact piece 18. The length l of the coiled spring 42 in its free state shown in FIG. 6 is larger than the height of the central portion of the plug contact portion 22*a* from the keep plate 44 when the end portion of the movable part 22 is in contact with the stationary contact piece 32. Therefore, the length l of the coiled spring is naturally larger than the height h of the spring holder 43. The width of the spring holder 43 is slightly smaller than the inner diameter of the coiled spring 42**.

As illustrated in FIG. 3, grooves 45 and 46 are cut in the left and right side panels 24 and 25 on the inside thereof to extend from the rear open end of the body 11, and these grooves 45 and 46 are contiguous to and shallower than the guide grooves 26 and 27. The keep plate 44 is fixedly mounted in the body 11 with its opposing marginal portions inserted into the grooves 45 and 46. The keep plate 44 has lugs 47 and 48 formed integrally therewith on both sides thereof as shown in FIG. 6 and these lugs are engaged with the engaging holes 37 and 38 to lock the keep plate 44 in position. As depicted in FIGS. 3 and 4, the width of the keep plate 44 is a little smaller than the width of the stationary part 21 of the movable contact piece 18. It is sufficient that the lugs 28, 29 and 47, 48 merely engage with the engaging holes 37 and 38; the engaging holes 37 and 38 may also be provided in the form of recesses.

The spring holder 43 is inserted into the coiled spring 42 to stably hold it in the body 11. The height h of the spring holder 43 is so selected that, as shown in FIG. 5, when the plug 41 is inserted into the body 11, the spring holder 43 does not hinder the disengagement of the movable contact piece 18 from the stationary contact piece 32, and when some force is applied to move the plug 41 downwardly against the movable part 22, the spring holder 43 makes contact with the plug contact part **22*a* of the movable contact piece 18 to receive therethrough the peripheral surface of the plug 41, thereby protecting the movable contact piece 18** from excessive displacement.

By slightly bending the stationary part 21 so that its central portion protrudes a little towards the upper panel 30, the stationary part 21 can be resiliently contacted with and held by the keep plate 44.

According to the above-described embodiment, since the resilient force of the movable contact piece 18 is supplemented by the coiled spring 42, the thickness of the movable contact piece 18 can be reduced. Consequently, even if the movable contact piece 18 is repeatedly subjected to elastic deformation by the plug 41, it is hardly fatigued, and hence is long-lived. Especially in the case of a miniaturized jack, the movable contact piece 18 is thin and small in resilient force but, on account of the presence of the coiled spring 42, the movable contact piece 18 engages the plug 41 and the stationary contact piece 32 with significant pressure, and a certain amount of force is needed to pull out the plug 41; as a result, when the plug 41 inserted into the body 11 it is firmly held in position.

Furthermore, when the plug 41 has been inserted into the body 11 and is then subjected, by some cause, to a turning force about the sleeve 14 in the counter clockwise direction in FIG. 5 which tends to excessively displace the movable part 22 of the movable contact piece 18, the underside of the plug contact part 22 of the movable contact piece 18 abuts the tip of the spring holder 43 to prevent further rotational movement of the plug 41. Thus the movable part 22 is free of excessive displacement; as a result there is no possibility of permanent deformation of the movable contact piece 18 which would result in the jack becoming defective.

Since the coiled spring 42 is positioned and securely held by the spring holder 43, there is no fear of the coiled spring 42 getting out of position while in use and it is held in its correct posture. Besides, holding of the coiled spring 42 by the spring holder 43 facilitates the assembling of the jack. Moreover, in the foregoing embodiment, the keep plate 44 of the spring holder 43 serves to press the stationary part 21 of the movable contact piece 18 against the body 11. In this case, the movable contact piece 18, the coiled spring 42 and the spring holder 43 assembled together can be mounted in the body 11 in one process by inserting the marginal portions of the movable contact piece 18 and the plate 44 into the grooves 26, 45 and 27, 46.

Figure 7:
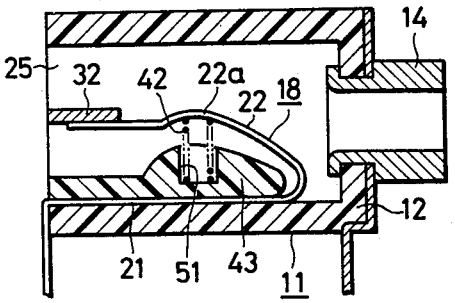
FIG. 7 is a sectional view corresponding to FIG. 5, showing another embodiment of the jack of the present invention.
Figure 8:
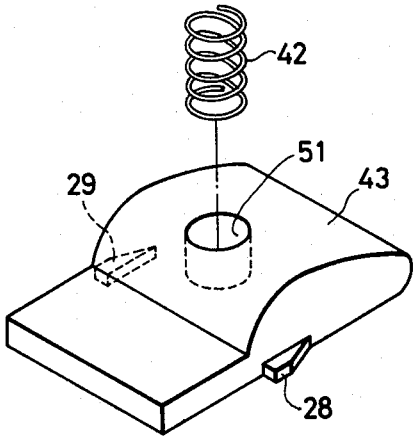
FIG. 8 is a perspective view showing the spring holder 43 used in FIG. 7.

Various other arrangements can be employed for holding the coiled spring 42 and preventing excessive displacement of the movable contact 18. For example, as shown in FIGS. 7 and 8 in which the parts corresponding to those in FIGS. 1 to 6 are identified by the same reference numerals, the spring holder 43 is formed by a molding of a synthetic resinous material and it is disposed on the stationary part 21 of the movable contact piece 18 to press it against the bottom panel 23 of the body 11. The upper surface of the spring holder 43 on the side of the movable part 22 of the movable contact piece 18 is formed to substantially conform to the movable part 22 but held apart therefrom. The spring holder 43 has a hole 51 therein, at a position corresponding to the plug contact portion 22*a* of the movable part 22, for carrying the coiled spring 42. The movable part 22 of the movable contact piece 18 is biased by the coiled spring 42 to be urged against the stationary contact piece 32. When the plug 41 in inserted into the body 11, the movable part 22 is disengaged from the stationary contact piece 32 and held sufficiently far apart therefrom. If, however, the movable part 22 of the movable contact piece 18 is likely to be subjected to excessive displacement, the movable part 22 is pressed against the spring holder 43, in particular, the underside of the plug contact portion 22*a* is urged against the spring holder 43 in conformity with its shape, and the force applied by the plug 41 through the plug contact portion 22*a* is received by the spring holder 43 thereby preventing excessive displacement of the movable part 22.

Figure 9:
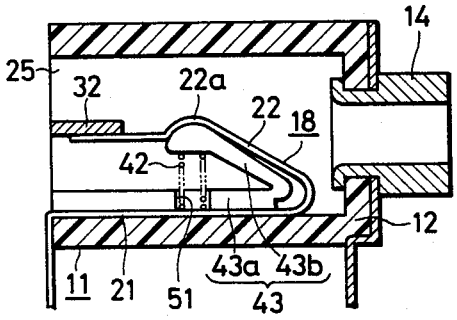
FIG. 9 is a sectional view corresponding to FIG. 5, illustrating another embodiment of the jack of the present invention.
Figure 10:
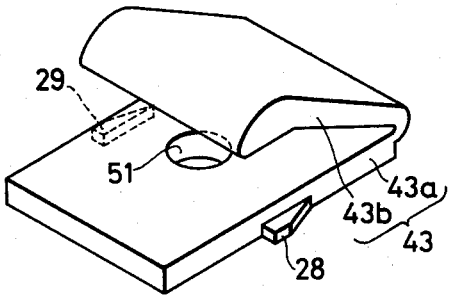
FIG. 10 is a perspective view showing the spring holder 43 used in FIG. 9.

FIGS. 9 and 10 illustrate another modification of the spring holder 43. In this case, the spring holder 43 is formed substantially in a V-shape to conform to the movable contact piece 18. One leg portion 43*a* of the spring holder 43 is plate-shaped and presses the stationary part 21 of the movable contact piece 18 against the body 11 and has the spring receiving hole 51. The other leg portion 43*b* of the spring holder 43 extend along the underside of the movable part 22. These leg portions 43*a* and 43*b* are formed relatively thick but their coupling portion is formed thin so that the leg portion 43*b* can be easily brought close to the leg portion 43*a*. Ths spring holder 43 is formed by a molding of a synthetic resinous material. The coiled spring 42 inserted in the hole 51 biases the movable part 22 of the movable contact piece 18 towards the stationary contact piece 32 through the leg portion 43*b* of the spring holder 43. When the movable contact piece 18 is likely to be excessively displaced by the plug 41 inserted into the body 11, the leg portion 43*b* is moved into contact with the leg portion 43*a*, in particular, the part of the leg portion 43*b* corresponding to the plug contact portion 22*a* of the movable contact piece 18 makes contact with the leg portion 43*a* to prevent excessive displacement of the movable contact piece 18. It should be noted that the spring receiving hole 51 can also be formed in the leg portion 43*b* instead of 43*a*, or in both the leg portions 43*a* and 43*b*.

Figure 11:
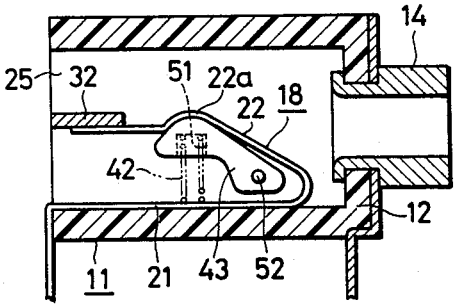
FIG. 11 is a sectional view corresponding to FIG. 5, illustrating still another embodiment of the jack of the present invention.
Figure 12:
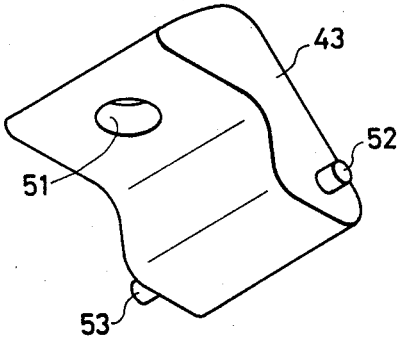
FIG. 12 is a perspective view showing the spring holder 43 employed in FIG. 11.

FIGS. 11 and 12 illustrate still another modified form of the spring holder 43. The spring holder 43 is pivotally mounted in the body 11 between the stationary part 21 and the movable part 22 of the movable contact piece 18 so that the upper surface of the spring holder 43 abuts against the underside of the movable part 22. For pivotal movement of the spring holder 43, pins 52 and 53 are formed integrally with the spring holder 43 on both sides thereof and inserted into bearing holes made in the left and right side panels 24 and 25 of the body 11, respectively. Also in this case, the spring holder 43 is formed by a molding of a synthetic resinous material and the spring receiving hole 51 is made in the spring holder 43 on the opposite side from the plug contact portion 22*a* for receiving the coiled spring 42. The projecting end of the coiled spring 42 abuts against the stationary part 21 of the movable contact piece 18 to bias the movable part 22 towards the stationary contact piece 32 through the spring holder 43. When the movable part 22 is likely to be excessively displaced by the plug 41 inserted into the body 11, the spring holder 43 is pressed down into contact with the stationary part 21 to prevent excessive displacement of the movable part 22.

While in the foregoing the present invention has been described as being applied to a jack of the type in which the movable contact piece is disengaged by the insertion of the plug from the stationary contact piece, the invention is also applicable to a jack in which the stationary contact piece is omitted and the plug, when inserted into the body, makes contact simply with the movable contact piece. Furthermore, the present invention can be applied to a jack in which pluralities of movable contact pieces and stationary contact pieces are incorporated. The movable contact piece is not limited specifically to the U-shaped one. In a jack in which the movable contact piece is disconnected by the insertion of the plug from the stationary contact piece and, in addition, in some cases, the movable contact piece is moved into contact with another stationary contact piece, the movable contact piece need not always be electrically connected with the plug. As will be appreciated, for instance, from the embodiment shown in FIG. 7, it is also possible to employ a structure in which the coiled spring 42 is urged against the free end portion of the movable part 22 and, for preventing excessive displacement of the movable part 22, the spring holder 43 is contacted with the underside of the plug contact portion 22*a*; namely, holding of the coiled spring and the prevention of excessive displacement of the movable part are performed at different portions of the spring holder 43.

It will be apparent that many modifications and variations may be effected without departing from the scope of the novel concepts of the present invention.

What is claimed is:

1. A jack comprising:

a hollow rectangular prismatic body fabricated of an insulating material, said body having a front panel, right and left side panels and top and bottom panels, the front panel having a plug insertion hole therein;

a U-shaped contact piece formed of a resilient sheet metal and mounted in said body, one of the two legs of said U-shaped contact piece being adapted to move when engaged by a plug inserted into said body through said plug insertion hole and the other of said two legs being a stationary part which is fixed to an inner wall of said bottom panel, said two legs being interconnected by a bent portion of said U-shaped contact piece which is positioned toward said front panel with said movable and stationary legs of said contact piece extending from said bent portion in directions away from said plug insertion hole;

a sheet metal keep plate mounted on said stationary leg of said U-shaped contact piece to press said stationary leg against said bottom panel, said keep plate having an upright portion acting as a spring holder, said upright portion being made by cutting and bending a portion of said keep plate to stand upright, the distance between the tip of said spring holder and said movable leg of said contact piece being selected so that when a plug inserted into said body engages the movable leg of said contact piece a portion of said movable leg will be brought into contact with the tip of said spring holder, thereby preventing said movable leg from excessive displacement by the plug inserted into the body; and a coiled spring held around said spring holder to bias said movable leg of said contact piece towards said top panel of said body, thereby to supplement the resiliency of said movable contact piece.

2. A jack according to claim 1 wherein marginal side portions of said keep plate and of said stationary leg are inserted into guide grooves cut in inner surfaces of said right and left side panels.

3. A jack according to claim 1 wherein said stationary leg of said U-shaped contact piece is slightly bent for resilient contact with said keep plate to stably fix said contact piece to said bottom panel of said body.

4. A jack comprising:

a hollow, rectangular prismatic body fabricated of an insulating material having a front panel, right and left side panels and top and bottom panels, said front panel having a plug insertion hole therein;

a U-shaped contact piece formed of a resilient sheet metal and mounted in said body, one of the two legs of said U-shaped contact piece being adapted to move when engaged by a plug inserted into said body through said plug insertion hole and the other of said two legs being a stationary part which is fixed to said bottom panel, said two legs being interconnected by a bent portion of said U-shaped contact piece which is positioned toward said front panel with said movable and stationary legs of said contact piece extending from said bent portion in directions away from said plug insertion hole; and a spring holder formed by a block of an insulating material and disposed on said stationary leg of said contact piece to press said stationary leg against said bottom panel, said spring holder having an upper surface portion which contacts the underside of a portion of said movable leg when said movable leg is engaged by a plug inserted into said body, thereby to prevent said movable leg of said contact piece from being excessively displaced by the inserted plug;

said spring holder having a receiving hole therein, and a coiled spring one end portion of which is inserted in said receiving hole and the other end portion of which applies a resilient force to the underside of said movable leg to supplement the resiliency of said U-shaped contact piece.

5. A jack according to claim 4 wherein the marginal side portions of said stationary leg of said contact piece are inserted into grooves cut in the inner surfaces of said right and left side panels respectively, said marginal side portions having lugs which engage holes made in said right and left side panels, and said spring holder also having lugs on both sides thereof which engage said holes respectively, thereby to secure said stationary leg of said contact piece to said bottom panel.

6. A jack comprising:

a hollow, rectangular prismatic body fabricated of an insulating material having a front panel, right and left side panels and top and bottom panels, said front panel having a plug insertion hole therein;

a contact piece formed of a resilient sheet metal and mounted in the body, said contact piece having a pair of legs which are interconnected to one another by a bent portion of said sheet metal, one of said legs being adapted to move when engaged by a plug inserted into said body through said plug insertion hole and the other of said legs being a stationary part which is fixed to said bottom panel, said bent portion of said contact piece being positioned adjacent said front panel with said movable and stationary legs of said contact piece extending from said bent portion in directions away from said plug insertion hole;

a spring holder formed by a V-shaped molding of a flexible synthetic resinous material to define a pair of spring holder leg portions which are interconnected to one another by a spring holder bent portion, said spring holder bent portion being thin enough to permit easy pivotal movement of said spring holder leg portions relative to each other, said spring holder being inserted between said movable leg and said stationary leg of said contact piece with said spring holder bent portion being disposed near the bent portion of said movable contact piece and with one of the leg portions of said spring holder being in contact with said stationary leg and the other spring holder leg portion extending along the underside of said movable leg of said contact piece, thereby to prevent said movable leg of said contact piece from being excessively displaced by a plug inserted into the body;

at least one of the leg portions of said spring holder having a receiving hole made therein, and a coiled spring held in said receiving hole and disposed between said leg portions of said spring holder to urge said one of the spring holder leg portions against said movable leg of said contact piece thereby to supplement the resiliency of said contact piece.

7. A jack comprising:

a hollow, rectangular prismatic body fabricated of an insulating material having a front panel, right and left side panels and top and bottom panels, said front panel having a plug insertion hole therein;

a contact piece formed of a resilient sheet metal and mounted in the body, said contact piece having a pair of legs which are interconnected to one another by a bent portion of said sheet metal, one of said legs being adapted to move when engaged by a plug inserted into said body through said plug insertion hole and the other of said legs being a stationary part which is fixed to said bottom panel, said bent portion of said contact piece being positioned adjacent said front panel with said movable and stationary legs of said contact piece extending from said bent portion in directions away from said plug insertion hole;

a spring holder formed by a block of a synthetic resinous material and disposed between said movable leg and said stationary leg of said contact piece in a manner to be rotatable about a fulcrum located adjacent the bent portion of said contact piece so that a free end portion of said spring holder is pressed into contact with said bottom panel before said movable leg is excessively displaced by the insertion of the plug;

said spring holder having a receiving hole made therein in facing relation to said stationary leg, and a coiled spring having one end portion thereof disposed in said receiving hole, said coiled spring being interposed between said spring holder and said bottom panel to urge said spring holder against the underside of said movable leg of said contact piece thereby to supplement the resiliency of said contact piece.

8. A jack according to claim 1 wherein said right and left side panels have engagement holes therein, the marginal side portions of said keep plate and stationary leg having lugs which engage said engagement holes thereby to fixedly secure said keep plate and said stationary leg to said body.

* * * * *